US007114581B2

(12) United States Patent
Aronstam et al.

(10) Patent No.: US 7,114,581 B2
(45) Date of Patent: Oct. 3, 2006

(54) ACTIVE CONTROLLED BOTTOMHOLE PRESSURE SYSTEM & METHOD

(75) Inventors: Peter Aronstam, Houston, TX (US); Volker Krueger, Celle (DE); Sven Krueger, Winsen/Aller (DE); Harald Grimmer, Lachendorf (DE); Roger Fincher, Conroe, TX (US); Larry Watkins, Conroe, TX (US); Peter Fontana, Amsterdam (NL)

(73) Assignee: Deep Vision LLC, Houston, TX (US)

( * ) Notice: Subject to any disclaimer, the term of this patent is extended or adjusted under 35 U.S.C. 154(b) by 261 days.

(21) Appl. No.: 10/783,471

(22) Filed: Feb. 20, 2004

(65) Prior Publication Data

US 2004/0206548 A1 Oct. 21, 2004

Related U.S. Application Data

(63) Continuation-in-part of application No. 10/716,106, filed on Nov. 17, 2003, now Pat. No. 6,854,532, which is a continuation of application No. 10/251,138, filed on Sep. 20, 2002, now abandoned, which is a continuation of application No. 10/094,208, filed on Mar. 8, 2002, now Pat. No. 6,648,081, which is a continuation of application No. 09/353,275, filed on Jul. 14, 1999, now Pat. No. 6,415,877.

(60) Provisional application No. 60/323,803, filed on Sep. 20, 2001, provisional application No. 60/108,601, filed on Nov. 16, 1998, provisional application No. 60/101,541, filed on Sep. 23, 1998, provisional application No. 60/095,188, filed on Aug. 3, 1998, provisional application No. 60/092,908, filed on Jul. 15, 1998.

(51) Int. Cl.
*E21B 7/00* (2006.01)

(52) U.S. Cl. ..... 175/57; 175/107; 175/324

(58) Field of Classification Search ..... 175/57, 175/65, 7, 5, 25, 48, 38, 217, 393, 339, 324; 166/368

See application file for complete search history.

(56) References Cited

U.S. PATENT DOCUMENTS 2,812,723 A 11/1957 Coberly (Continued)

FOREIGN PATENT DOCUMENTS

CA WO 02/14649 2/2002

(Continued)

OTHER PUBLICATIONS

*New Tool Addresses ECD Problem*, William Furlow, Offshore, pp. 88, 89, Jun. 2002.

(Continued)

*Primary Examiner*—Frank Tsay
(74) *Attorney, Agent, or Firm*—Madan, Mossman & Sriram, P.C.

(57) ABSTRACT

A wellbore drilling system has an umbilical that carries a drill bit in a wellbore. Drilling fluid pumped into the umbilical discharges at the drill bit bottom and returns through an annulus between the umbilical and the wellbore carrying entrained drill cuttings. An active differential pressure device (APD device), such as a jet pump, turbine or centrifugal pump, in fluid communication with the returning fluid creates a differential pressure across the device, which alters the pressure below or downhole of the device. The APD device can be driven by a positive displacement motor, a turbine, an electric motor, or a hydraulic motor. A controller controls the operation of the APD device in response to programmed instructions and/or one or more parameters of interest detected by one or more sensors. A preferred system is a closed loop system that maintains the wellbore at under-balance condition, at-balance condition or over-balance condition.

60 Claims, 8 Drawing Sheets

U.S. PATENT DOCUMENTS

| | | | |
|---|---|---|---|
| 2,946,565 | A | 7/1960 | Williams |
| 3,595,075 | A | 7/1971 | Dower |
| 3,603,409 | A | 9/1971 | Watkins |
| 3,677,353 | A | 7/1972 | Baker |
| 3,815,673 | A | 6/1974 | Bruce et al. |
| 3,958,651 | A | 5/1976 | Young |
| 4,022,285 | A | 5/1977 | Frank |
| 4,049,066 | A | 9/1977 | Richey |
| 4,063,602 | A | 12/1977 | Howell et al. |
| 4,091,881 | A | 5/1978 | Maus |
| 4,099,583 | A | 7/1978 | Maus |
| 4,108,257 | A | 8/1978 | Sizer |
| 4,134,461 | A | 1/1979 | Blomsma |
| 4,137,975 | A | 2/1979 | Pennock |
| 4,149,603 | A | 4/1979 | Arnold |
| 4,210,208 | A | 7/1980 | Shanks |
| 4,223,747 | A | 9/1980 | Marais |
| 4,240,513 | A | 12/1980 | Castel et al. |
| 4,291,772 | A | 9/1981 | Beynet |
| 4,368,787 | A | 1/1983 | Messenger |
| 4,436,166 | A | 3/1984 | Hayatdavoudi et al. |
| 4,440,239 | A | 4/1984 | Evans |
| 4,534,426 | A | 8/1985 | Hooper |
| 4,613,003 | A | 9/1986 | Ruhle |
| 4,630,691 | A | 12/1986 | Hooper |
| 4,744,426 | A | 5/1988 | Reed |
| 4,813,495 | A | 3/1989 | Leach |
| 5,150,757 | A | 9/1992 | Nunley |
| 5,168,932 | A | 12/1992 | Worrall et al. |
| 5,355,967 | A | 10/1994 | Mueller et al. |
| 5,651,420 | A | 7/1997 | Tibbitts et al. |
| 5,775,443 | A | 7/1998 | Lott |
| 6,142,236 | A | 11/2000 | Brammer et al. |
| 6,216,799 | B1 | 4/2001 | Gonzalez |
| 6,276,455 | B1 | 8/2001 | Gonzalez |
| 6,374,925 | B1 | 4/2002 | Elkins et al. |
| 6,415,877 | B1 | 7/2002 | Fincher et al. |
| 6,527,513 | B1 | 3/2003 | Van Drentham-Susman et al. ..... 415/202 |
| 6,719,071 | B1 | 4/2004 | Moyes ..... 175/65 |
| 2003/0146001 | A1 | 8/2003 | Hosie et al. ..... 166/369 |

FOREIGN PATENT DOCUMENTS

| | | |
|---|---|---|
| EP | 0290250 | 9/1988 |
| EP | 0 566 290 | 10/1993 |
| WO | WO 00/50731 | 8/2000 |
| WO | WO 03/023182 A1 | 3/2003 |

OTHER PUBLICATIONS

*Technologies Manage Well Pressures*, Don M. Hannegan, Ron Divine, The American Oil & Gas Reporter, Sep. 2001.

*Continuous Circulation Drilling*, L.J. Ayling, Maris Int'l Ltd.; J.W. Jenner, Maris Int'l Ltd., H. Elkins, Varco Drilling Equipment, this paper prepared for presentation at the 2002 Offshore Technology Conference, Houston, Texas May 6-9, 2002.

ACTIVE CONTROLLED BOTTOMHOLE PRESSURE SYSTEM & METHOD

CROSS-REFERENCE TO RELATED APPLICATIONS

This application is a continuation of U.S. patent application Ser. No. 10/251,138 filed Sep. 20$^{th}$, 2002, now abandoned which takes priority from U.S. provisional patent application Ser. No. 60/323,803 filed on Sep. 20, 2001, titled "Active Controlled Bottomhole Pressure System and Method."

This application is a continuation-in-part of U.S. patent application Ser. No. 10/716,106 filed on Nov. 17$^{th}$, 2003, now U.S. Pat. No. 6,854,532 which is a continuation of U.S. patent application Ser. No. 10/094,208, filed Mar. 8, 2002, now U.S. Pat. No. 6,648,081 granted on Nov. 18, 2003, which is a continuation of U.S. application Ser. No. 09/353,275, filed Jul. 14, 1999, now U.S. Pat. No. 6,415,877, which claims benefit of U.S. Provisional Application No. 60/108,601, filed Nov. 16, 1998, U.S. Provisional Application No. 60/101,541, filed Sep. 23, 1998, U.S. Provisional Application No. 60/092,908, filed, Jul. 15, 1998 and U.S. Provisional Application No. 60/095,188, filed Aug. 3, 1998.

FIELD OF THE INVENTION

This invention relates generally to oilfield wellbore drilling systems and more particularly to drilling systems that utilize active control of bottomhole pressure or equivalent circulating density during drilling of the wellbores.

BACKGROUND OF THE ART

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to carry the drilling of assembly. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped under pressure from a source at the surface down the tubing. The drilling fluid drives the mud motor and then discharges at the bottom of the drill bit. The drilling fluid returns uphole via the annulus between the drill string and the wellbore inside and carries with it pieces of formation (commonly referred to as the "cuttings") cut or produced by the drill bit in drilling the wellbore.

For drilling wellbores under water (referred to in the industry as "offshore" or "subsea" drilling) tubing is provided at a work station (located on a vessel or platform). One or more tubing injectors or rigs are used to move the tubing into and out of the wellbore. In riser-type drilling, a riser, which is formed by joining sections of casing or pipe, is deployed between the drilling vessel and the wellhead equipment at the sea bottom and is utilized to guide the tubing to the wellhead. The riser also serves as a conduit for fluid returning from the wellhead to the sea surface.

During drilling, the drilling operator attempts to carefully control the fluid density at the surface so as to control pressure in the wellbore, including the bottomhole pressure.

Typically, the operator maintains the hydrostatic pressure of the drilling fluid in the wellbore above the formation or pore pressure to avoid well blow-out. The density of the drilling fluid and the fluid flow rate largely determine the effectiveness of the drilling fluid to carry the cuttings to the surface. One important downhole parameter controlled during drilling is the bottomhole pressure, which in turn controls the equivalent circulating density ("ECD") of the fluid at the wellbore bottom.

This term, ECD, describes the condition that exists when the drilling mud in the well is circulated. The friction pressure caused by the fluid circulating through the open hole and the casing(s) on its way back to the surface, causes an increase in the pressure profile along this path that is different from the pressure profile when the well is in a static condition (i.e., not circulating). In addition to the increase in pressure while circulating, there is an additional increase in pressure while drilling due to the introduction of drill solids into the fluid. This negative effect of the increase in pressure along the annulus of the well is an increase of the pressure which can fracture the formation at the shoe of the last casing. This can reduce the amount of hole that can be drilled before having to set an additional casing. In addition, the rate of circulation that can be achieved is also limited. Also, due to this circulating pressure increase, the ability to clean the hole is severely restricted. This condition is exacerbated when drilling an offshore well. In offshore wells, the difference between the fracture pressures in the shallow sections of the well and the pore pressures of the deeper sections is considerably smaller compared to on shore wellbores. This is due to the seawater gradient versus the gradient that would exist if there were soil overburden for the same depth.

In some drilling applications, it is desired to drill the wellbore at at-balance condition or at under-balanced condition. The term at-balance means that the pressure in the wellbore is maintained at or near the formation pressure. The under-balanced condition means that the wellbore pressure is below the formation pressure. These two conditions are desirable because the drilling fluid under such conditions does not penetrate into the formation, thereby leaving the formation virgin for performing formation evaluation tests and measurements. In order to be able to drill a well to a total wellbore depth at the botomhole, ECD must be reduced or controlled. In subsea wells, one approach is to use a mud-filled riser to form a subsea fluid circulation system utilizing the tubing, BHA, the annulus between the tubing and the wellbore and the mud filled riser, and then inject gas (or some other low density liquid) in the primary drilling fluid (typically in the annulus adjacent the BHA) to reduce the density of fluid downstream (i.e., in the remainder of the fluid circulation system). This so-called "dual density" approach is often referred to as drilling with compressible fluids.

Another method for changing the density gradient in a deepwater return fluid path has been proposed, but not used in practical application. This approach proposes to use a tank, such as an elastic bag, at the sea floor for receiving return fluid from the wellbore annulus and holding it at the hydrostatic pressure of the water at the sea floor. Independent of the flow in the annulus, a separate return line connected to the sea floor storage tank and a subsea lifting pump delivers the return fluid to the surface. Although this technique (which is referred to as "dual gradient" drilling) would use a single fluid, it would also require a discontinuity in the hydraulic gradient line between the sea floor storage tank and the subsea lifting pump. This requires close monitoring and control of the pressure at the subsea storage tank, subsea hydrostatic water pressure, subsea lifting pump operation and the surface pump delivering drilling fluids under pressure into the tubing for flow downhole. The level of complexity of the required subsea instrumentation and controls as well as the difficulty of deployment of the system has delayed (if not altogether prevented) the practical application of the "dual gradient" system.

Another approach is described in U.S. patent application Ser. No. 09/353,275, filed on Jul. 14, 1999 and assigned to the assignee of the present application. The U.S. patent application Ser. No. 09/353,275 is incorporated herein by reference in its entirety. One embodiment of this application describes a riser less system wherein a centrifugal pump in a separate return line controls the fluid flow to the surface and thus the equivalent circulating density.

The present invention provides a wellbore system wherein the bottomhole pressure and hence the equivalent circulating density is controlled by creating a pressure differential at a selected location in the return fluid path with an active pressure differential device to reduce or control the bottomhole pressure. The present system is relatively easy to incorporate in new and existing systems.

SUMMARY OF THE INVENTION

The present invention provides wellbore systems for performing downhole wellbore operations for both land and offshore wellbores. Such drilling systems include a rig that moves an umbilical (e.g., drill string) into and out of the wellbore. A bottomhole assembly, carrying the drill bit, is attached to the bottom end of the drill string. A well control assembly or equipment on the well receives the bottomhole assembly and the tubing. A drilling fluid system supplies a drilling fluid into the tubing, which discharges at the drill bit and returns to the well control equipment carrying the drill cuttings via the annulus between the drill string and the wellbore. A riser dispersed between the wellhead equipment and the surface guides the drill string and provides a conduit for moving the returning fluid to the surface.

In one embodiment of the present invention, an active pressure differential device moves in the wellbore as the drill string is moved. In an alternative embodiment, the active differential pressure device is attached to the wellbore inside or wall and remains stationary relative to the wellbore during drilling. The device is operated during drilling, i.e., when the drilling fluid is circulating through the wellbore, to create a pressure differential across the device. This pressure differential alters the pressure on the wellbore below or downhole of the device. The device may be controlled to reduce the bottomhole pressure by a certain amount, to maintain the bottomhole pressure at a certain value, or within a certain range. By severing or restricting the flow through the device, the bottomhole pressure may be increased.

The system also includes downhole devices for performing a variety of functions. Exemplary downhole devices include devices that control the drilling flow rate and flow paths. For example, the system can include one or more flow-control devices that can stop the flow of the fluid in the drill string and/or the annulus. Such flow-control devices can be configured to direct fluid in drill string into the annulus and/or bypass return fluid around the APD device. Another exemplary downhole device can be configured for processing the cuttings (e.g., reduction of cutting size) and other debris flowing in the annulus. For example, a comminution device can be disposed in the annulus upstream of the APD device.

In a preferred embodiment, sensors communicate with a controller via a telemetry system to maintain the wellbore pressure at a zone of interest at a selected pressure or range of pressures. The sensors are strategically positioned throughout the system to provide information or data relating to one or more selected parameters of interest such as drilling parameters, drilling assembly or BHA parameters, and formation or formation evaluation parameters. The controller for suitable for drilling operations preferably includes programs for maintaining the wellbore pressure at zone at under-balance condition, at at-balance condition or at over-balanced condition. The controller may be programmed to activate downhole devices according to programmed instructions or upon the occurrence of a particular condition.

Exemplary configurations for the APD Device and associated drive includes a moineau-type pump coupled to positive displacement motor/drive via a shaft assembly. Another exemplary configuration includes a turbine drive coupled to a centrifugal-type pump via a shaft assembly. Preferably, a high-pressure seal separates a supply fluid flowing through the motor from a return fluid flowing through the pump. In a preferred embodiment, the seal is configured to bear either or both of radial and axial (thrust) forces.

In still other configurations, a positive displacement motor can drive an intermediate device such as a hydraulic motor, which drives the APD Device. Alternatively, a jet pump can be used, which can eliminate the need for a drive/motor. Moreover, pumps incorporating one or more pistons, such as hammer pumps, may also be suitable for certain applications. In still other configurations, the APD Device canb be driven by an electric motor. The electric motor can be positioned external to a drill string or formed integral with a drill string. In a preferred arrangement, varying the speed of the electrical motor directly controls the speed of the rotor in the APD device, and thus the pressure differential across the APD Device.

Bypass devices are provided to allow fluid circulation in the wellbore during tripping of the system, to control the operating set points of the APD Device and/or associated drive/motor, and to provide a discharge mechanism to relieve fluid pressure. For examples, the bypass devices can selectively channel fluid around the motor/drive and the APD Device and selectively discharge drilling fluid from the drill string into the annulus. In one arrangement, the bypass device for the pump can also function as a particle bypass line for the APD device. Alternatively, a separate particle bypass can be used in addition to the pump bypass for such a function. Additionally, an annular seal (not shown) in certain embodiments can be disposed around the APD device to enable a pressure differential across the APD Device.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing.

DETAILED DESCRIPTION OF PREFERRED EMBODIMENTS

Figure 1A:
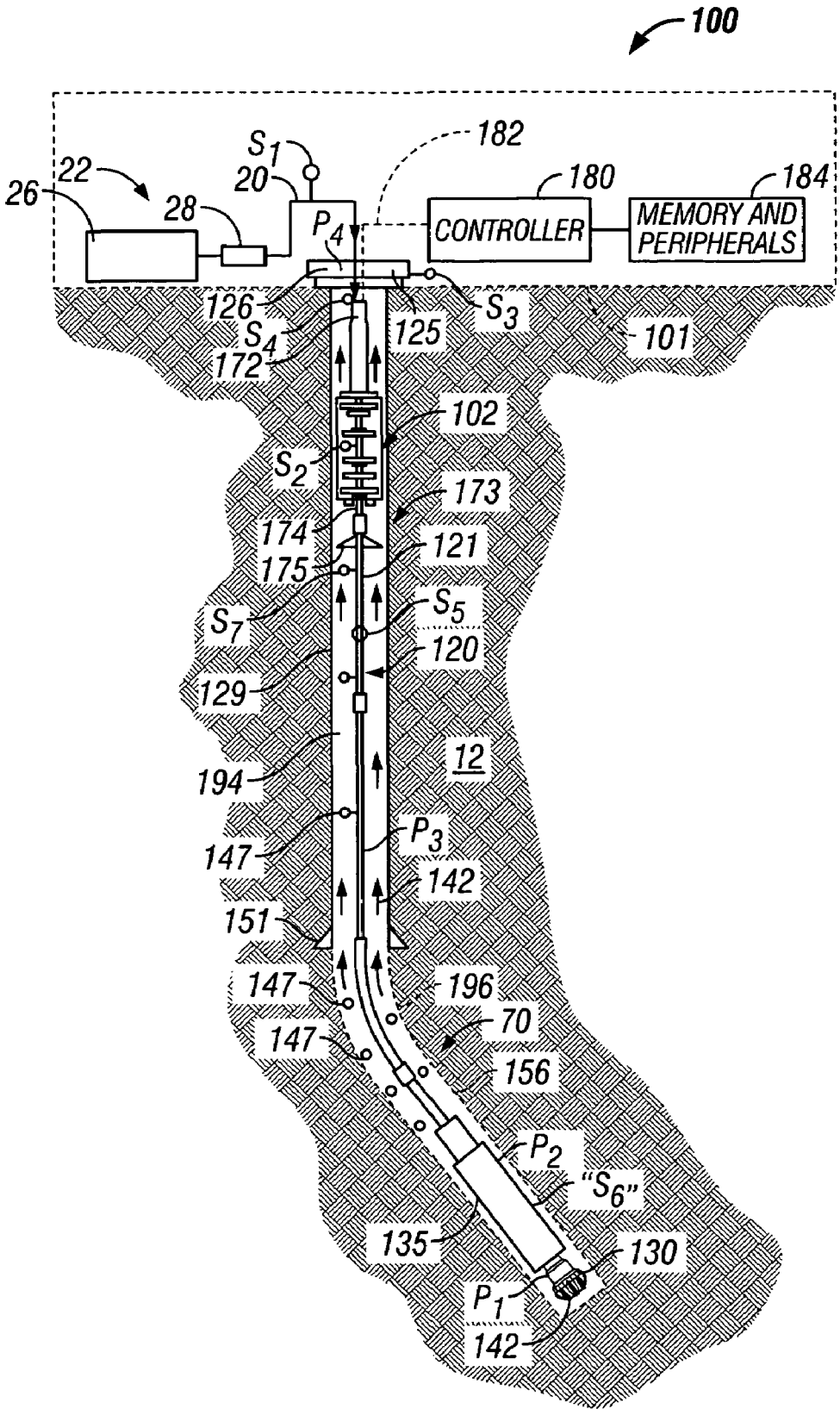
FIG. 1A is a schematic illustration of one embodiment of a system using an active pressure differential device to manage pressure in a predetermined wellbore location.

Referring initially to FIG. 1A, there is schematically illustrated a system for performing one or more operations related to the construction, logging, completion or workover of a hydrocarbon producing well. In particular, FIG. 1A shows a schematic elevation view of one embodiment of a wellbore drilling system 100 for drilling wellbore 90 using conventional drilling fluid circulation. The drilling system 100 is a rig for land wells and includes a drilling platform 101, which may be a drill ship or another suitable surface workstation such as a floating platform or a semi-submersible for offshore wells. For offshore operations, additional known equipment such as a riser and subsea wellhead will typically be used. To drill a wellbore 90, well control equipment 125 (also referred to as the wellhead equipment) is placed above the wellbore 90. The wellhead equipment 125 includes a blow-out-preventer stack 126 and a lubricator (not shown) with its associated flow control.

This system 100 further includes a well tool such as a drilling assembly or a bottomhole assembly ("BHA") 135 at the bottom of a suitable umbilical such as drill string or tubing 121 (such terms will be used interchangeably). In a preferred embodiment, the BHA 135 includes a drill bit 130 adapted to disintegrate rock and earth. The bit can be rotated by a surface rotary drive or a motor using pressurized fluid (e.g., mud motor) or an electrically driven motor. The tubing 121 can be formed partially or fully of drill pipe, metal or composite coiled tubing, liner, casing or other known members. Additionally, the tubing 121 can include data and power transmission carriers such fluid conduits, fiber optics, and metal conductors. Conventionally, the tubing 121 is placed at the drilling platform 101. To drill the wellbore 90, the BHA 135 is conveyed from the drilling platform 101 to the wellhead equipment 125 and then inserted into the wellbore 90. The tubing 121 is moved into and out of the wellbore 90 by a suitable tubing injection system.

During drilling, a drilling fluid from a surface mud system 22 is pumped under pressure down the tubing 121 (a "supply fluid"). The mud system 22 includes a mud pit or supply source 26 and one or more pumps 28. In one embodiment, the supply fluid operates a mud motor in the BHA 135, which in turn rotates the drill bit 130. The drill string 121 rotation can also be used to rotate the drill bit 130, either in conjunction with or separately from the mud motor. The drill bit 130 disintegrates the formation (rock) into cuttings 147. The drilling fluid leaving the drill bit travels uphole through the annulus 194 between the drill string 121 and the wellbore wall or inside 196, carrying the drill cuttings 147 therewith (a "return fluid"). The return fluid discharges into a separator (not shown) that separates the cuttings 147 and other solids from the return fluid and discharges the clean fluid back into the mud pit 26. As shown in FIG. 1A, the clean mud is pumped through the tubing 121 while the mud with cuttings 147 returns to the surface via the annulus 194 up to the wellhead equipment 125.

Once the well 90 has been drilled to a certain depth, casing 129 with a casing shoe 151 at the bottom is installed. The drilling is then continued to drill the well to a desired depth that will include one or more production sections, such as section 155. The section below the casing shoe 151 may not be cased until it is desired to complete the well, which leaves the bottom section of the well as an open hole, as shown by numeral 156.

As noted above, the present invention provides a drilling system for controlling bottomhole pressure at a zone of interest designated by the numeral 155 and thereby the ECD effect on the wellbore. In one embodiment of the present invention, to manage or control the pressure at the zone 155, an active pressure differential device ("APD Device") 170 is fluidicly coupled to return fluid downstream of the zone of interest 155. The active pressure differential device is a device that is capable of creating a pressure differential "$\Delta P$" across the device. This controlled pressure drop reduces the pressure upstream of the APD Device 170 and particularly in zone 155.

The system 100 also includes downhole devices that separately or cooperatively perform one or more functions such as controlling the flow rate of the drilling fluid and controlling the flow paths of the drilling fluid. For example, the system 100 can include one or more flow-control devices that can stop the flow of the fluid in the drill string and/or the annulus 194. FIG. 1A shows an exemplary flow-control device 173 that includes a device 174 that can block the fluid flow within the drill string 121 and a device 175 that blocks can block fluid flow through the annulus 194. The device 173 can be activated when a particular condition occurs to insulate the well above and below the flow-control device 173. For example, the flow-control device 173 may be activated to block fluid flow communication when drilling fluid circulation is stopped so as to isolate the sections above and below the device 173, thereby maintaining the wellbore below the device 173 at or substantially at the pressure condition prior to the stopping of the fluid circulation.

The flow-control devices 174, 175 can also be configured to selectively control the flow path of the drilling fluid. For example, the flow-control device 174 in the drill pipe 121 can be configured to direct some or all of the fluid in drill string 121 into the annulus 194. Moreover, one or both of the flow-control devices 174, 175 can be configured to bypass some or all of the return fluid around the APD device 170. Such an arrangement may be useful, for instance, to assist in lifting cuttings to the surface. The flow-control device 173 may include check-valves, packers and any other suitable device. Such devices may automatically activate upon the occurrence of a particular event or condition.

The system 100 also includes downhole devices for processing the cuttings (e.g., reduction of cutting size) and other debris flowing in the annulus 194. For example, a comminution device 176 can be disposed in the annulus 194 upstream of the APD device 170 to reduce the size of entrained cutting and other debris. The comminution device 176 can use known members such as blades, teeth, or rollers to crush, pulverize or otherwise disintegrate cuttings and debris entrained in the fluid flowing in the annulus 194. The comminution device 176 can be operated by an electric motor, a hydraulic motor, by rotation of drill string or other suitable means. The comminution device 176 can also be integrated into the APD device 170. For instance, if a multi-stage turbine is used as the APD device 170, then the stages adjacent the inlet to the turbine can be replaced with blades adapted to cut or shear particles before they pass through the blades of the remaining turbine stages.

Sensors $S_{1-n}$ are strategically positioned throughout the system 100 to provide information or data relating to one or more selected parameters of interest (pressure, flow rate, temperature). In a preferred embodiment, the downhole devices and sensors $S_{1-n}$ communicate with a controller 180 via a telemetry system (not shown). Using data provided by the sensors $S_{1-n}$, the controller 180 maintains the wellbore pressure at zone 155 at a selected pressure or range of pressures. The controller 180 maintains the selected pressure by controlling the APD device 170 (e.g., adjusting amount of energy added to the return fluid line) and/or the downhole devices (e.g., adjusting flow rate through a restriction such as a valve).

When configured for drilling operations, the sensors $S_{1-n}$ provide measurements relating to a variety of drilling parameters, such as fluid pressure, fluid flow rate, rotational speed of pumps and like devices, temperature, weight-on bit, rate of penetration, etc., drilling assembly or BHA parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. One preferred type of sensor is a pressure sensor for measuring pressure at one or more locations. Referring still to FIG. 1A, pressure sensor $P_1$ provides pressure data in the BHA, sensor $P_2$ provides pressure data in the annulus, pressure sensor $P_3$ in the supply fluid, and pressure sensor $P_4$ provides pressure data at the surface. Other pressure sensors may be used to provide pressure data at any other desired place in the system 100. Additionally, the system 100 includes fluid flow sensors such as sensor V that provides measurement of fluid flow at one or more places in the system.

Further, the status and condition of equipment as well as parameters relating to ambient conditions (e.g., pressure and other parameters listed above) in the system 100 can be monitored by sensors positioned throughout the system 100: exemplary locations including at the surface (S1), at the APD device 170 (S2), at the wellhead equipment 125 (S3), in the supply fluid (S4), along the tubing 121 (S5), at the well tool 135 (S6), in the return fluid upstream of the APD device 170 (S7), and in the return fluid downstream of the APD device 170 (S8). It should be understood that other locations may also be used for the sensors $S_{1-n}$.

The controller 180 for suitable for drilling operations preferably includes programs for maintaining the wellbore pressure at zone 155 at under-balance condition, at at-balance condition or at over-balanced condition. The controller 180 includes one or more processors that process signals from the various sensors in the drilling assembly and also controls their operation. The data provided by these sensors $S_{1-n}$ and control signals transmitted by the controller 180 to control downhole devices such as devices 173–176 are communicated by a suitable two-way telemetry system (not shown). A separate processor may be used for each sensor or device. Each sensor may also have additional circuitry for its unique operations. The controller 180, which may be either downhole or at the surface, is used herein in the generic sense for simplicity and ease of understanding and not as a limitation because the use and operation of such controllers is known in the art. The controller 180 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 30, downhole devices such as devices 173–175 and the surface equipment via the two-way telemetry. In other embodiments, the controller 180 can be a hydro-mechanical device that incorporates known mechanisms (valves, biased members, linkages cooperating to actuate tools under, for example, preset conditions).

For convenience, a single controller 180 is shown. It should be understood, however, that a plurality of controllers 180 can also be used. For example, a downhole controller can be used to collect, process and transmit data to a surface controller, which further processes the data and transmits appropriate control signals downhole. Other variations for dividing data processing tasks and generating control signals can also be used.

In general, however, during operation, the controller 180 receives the information regarding a parameter of interest and adjusts one or more downhole devices and/or APD device 170 to provide the desired pressure or range or pressure in the vicinity of the zone of interest 155. For example, the controller 180 can receive pressure information from one or more of the sensors ($S_1$–$S_n$) in the system 100. The controller 180 may control the APD Device 170 in response to one or more of: pressure, fluid flow, a formation characteristic, a wellbore characteristic and a fluid characteristic, a surface measured parameter or a parameter measured in the drill string. The controller 180 determines the ECD and adjusts the energy input to the APD device 170 to maintain the ECD at a desired or predetermined value or within a desired or predetermined range. The wellbore system 100 thus provides a closed loop system for controlling the ECD in response to one or more parameters of interest during drilling of a wellbore. This system is relatively simple and efficient and can be incorporated into new or existing drilling systems and readily adapted to support other well construction, completion, and work-over activities.

In the embodiment shown in FIG. 1A, the APD Device 170 is shown as a turbine attached to the drill string 121 that operates within the annulus 194. Other embodiments, described in further detail below can include centrifugal pumps, positive displacement pump, jet pumps and other like devices. During drilling, the APD Device 170 moves in the wellbore 90 along with the drill string 121. The return fluid can flow through the APD Device 170 whether or not the turbine is operating. However, the APD Device 170, when operated creates a differential pressure thereacross.

As described above, the system 100 in one embodiment includes a controller 180 that includes a memory and peripherals 184 for controlling the operation of the APD Device 170, the devices 173–176, and/or the bottomhole assembly 135. In FIG. 1A, the controller 180 is shown placed at the surface. It, however, may be located adjacent the APD Device 170, in the BHA 135 or at any other suitable location. The controller 180 controls the APD Device to create a desired amount of ΔP across the device, which alters the bottomhole pressure accordingly. Alternatively, the controller 180 may be programmed to activate the flow-control device 173 (or other downhole devices) according to programmed instructions or upon the occurrence of a particular condition. Thus, the controller 180 can control the APD Device in response to sensor data regarding a parameter of interest, according to programmed instructions provided to said APD Device, or in response to instructions provided to said APD Device from a remote location. The controller 180 can, thus, operate autonomously or interactively.

During drilling, the controller 180 controls the operation of the APD Device to create a certain pressure differential across the device so as to alter the pressure on the formation or the bottomhole pressure. The controller 180 may be programmed to maintain the wellbore pressure at a value or range of values that provide an under-balance condition, an at-balance condition or an over-balanced condition. In one embodiment, the differential pressure may be altered by altering the speed of the APD Device. For instance, the bottomhole pressure may be maintained at a preselected value or within a selected range relative to a parameter of interest such as the formation pressure. The controller 180 may receive signals from one or more sensors in the system 100 and in response thereto control the operation of the APD Device to create the desired pressure differential. The controller 180 may contain pre-programmed instructions and autonomously control the APD Device or respond to signals received from another device that may be remotely located from the APD Device.

Figure 1B:
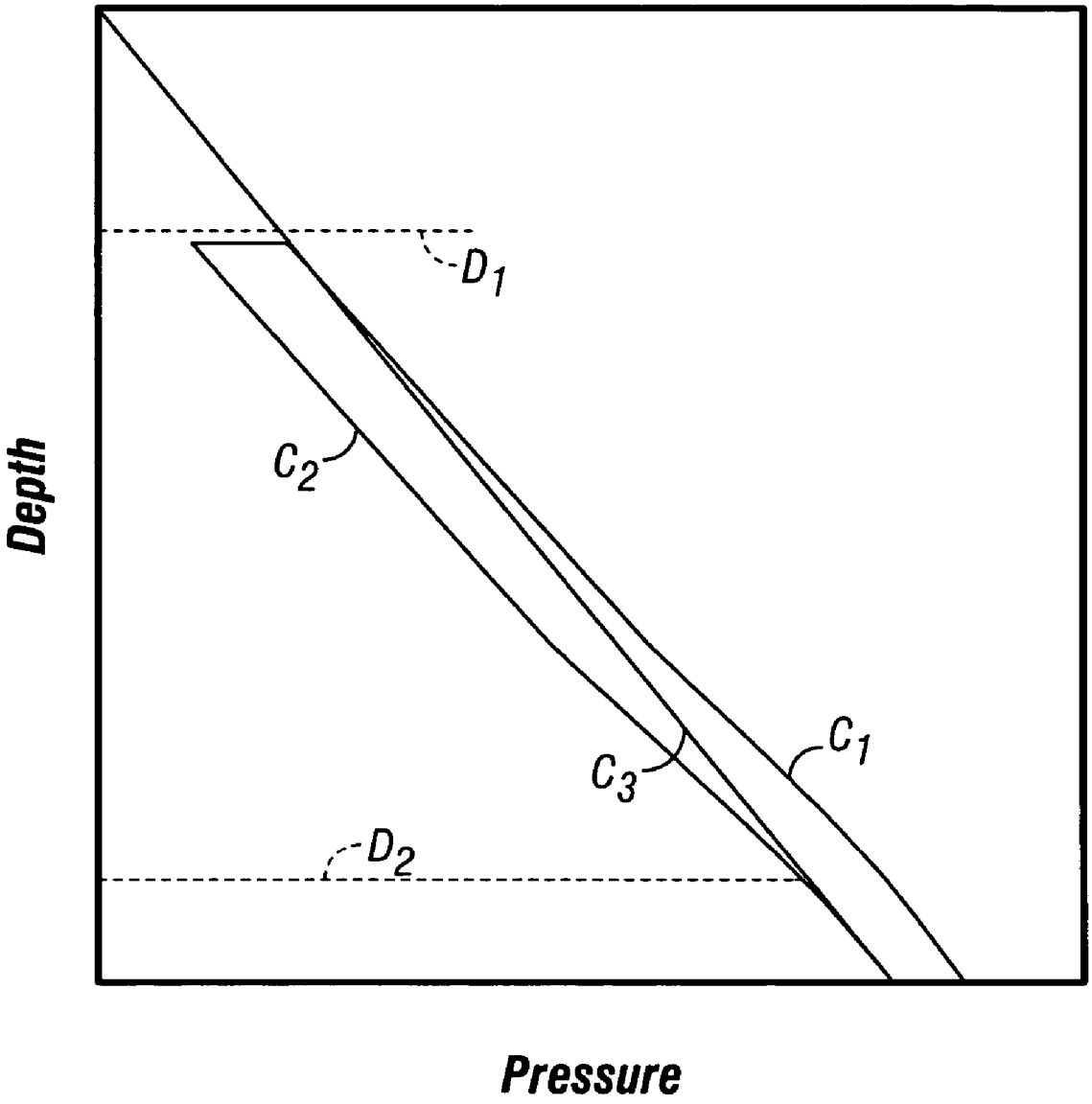
FIG. 1B graphically illustrates the effect of an operating active pressure differential device upon the pressure at a predetermined wellbore location.

FIG. 1B graphically illustrates the ECD control provided by the above-described embodiment of the present invention and references FIG. 1A for convenience. FIG. 1A shows the APD device 170 at a depth D1 and a representative location in the wellbore in the vicinity of the well tool 30 at a lower depth D2. FIG. 1B provides a depth versus pressure graph having a first curve C1 representative of a pressure gradient before operation of the system 100 and a second curve C2 representative of a pressure gradients during operation of the system 100. Curve C3 represents a theoretical curve wherein the ECD condition is not present; i.e., when the well is static and not circulating and is free of drill cuttings. It will be seen that a target or selected pressure at depth D2 under curve C3 cannot be met with curve C1. Advantageously, the system 100 reduces the hydrostatic pressure at depth D1 and thus shifts the pressure gradient as shown by curve C3, which can provide the desired predetermined pressure at depth D2. In most instances, this shift is roughly the pressure drop provided by the APD device 170.

Figure 2:
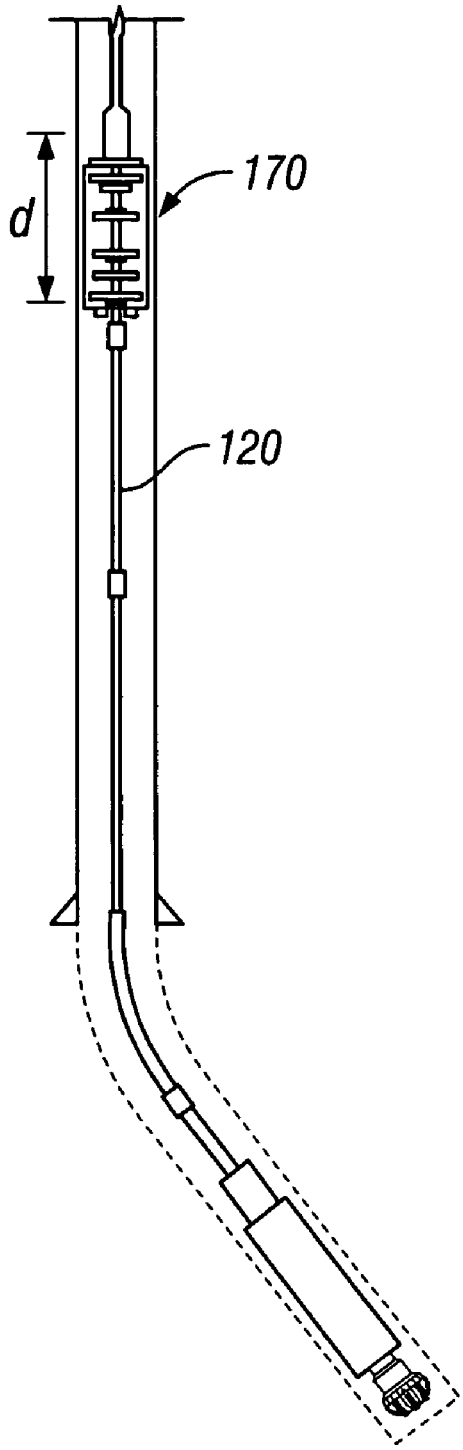
FIG. 2 is a schematic elevation view of FIG. 1A after the drill string and the active pressure differential device have moved a certain distance in the earth formation from the location shown in FIG. 1A.

FIG. 2 shows the drill string after it has moved the distance "d" shown by $t_1$-$t_2$. Since the APD Device 170 is attached to the drill string 121, the APD Device 170 also is shown moved by the distance d.

Figure 3:
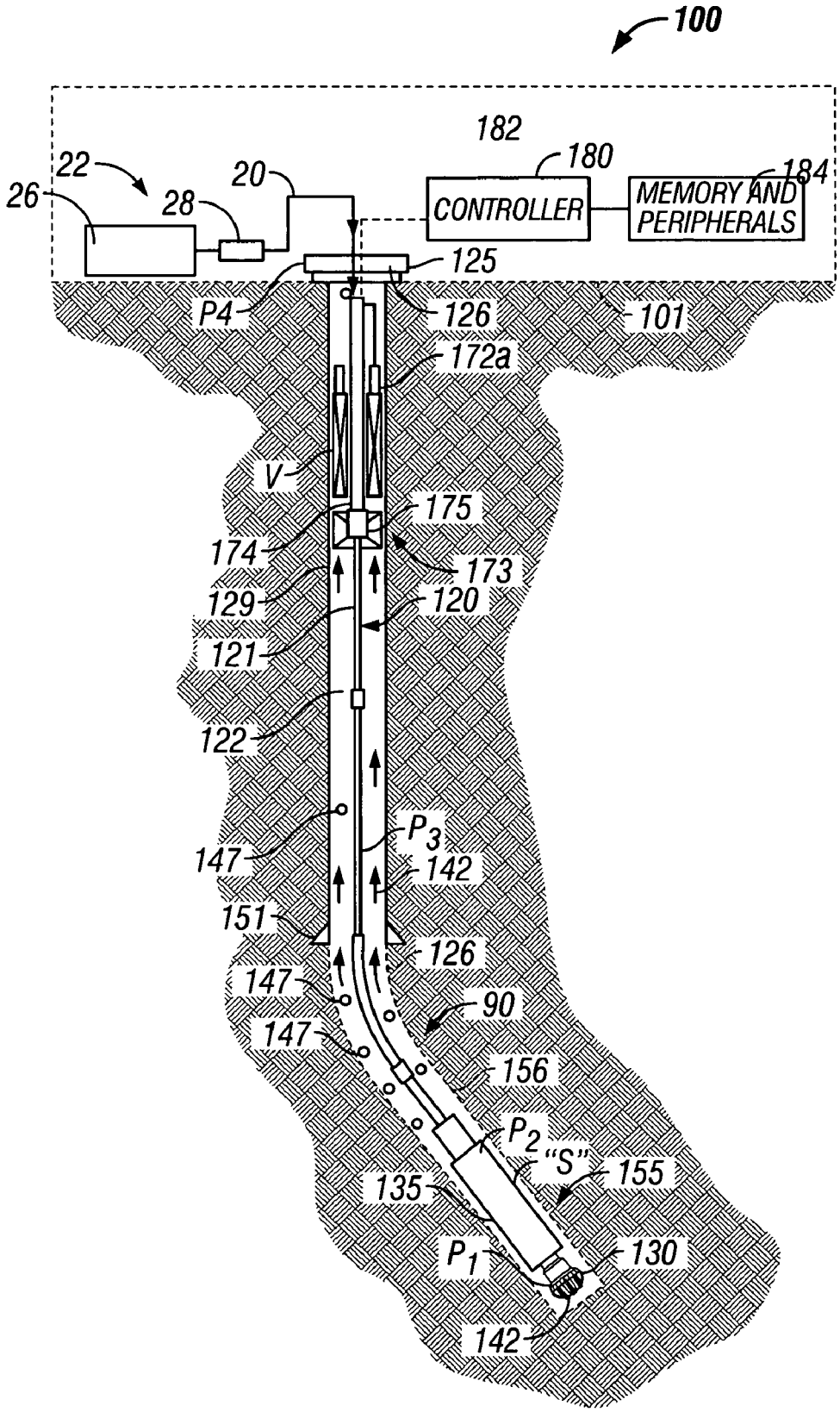
FIG. 3 is a schematic elevation view of an alternative embodiment of the wellbore system wherein the active pressure differential device is attached to the wellbore inside.
Figure 4A:
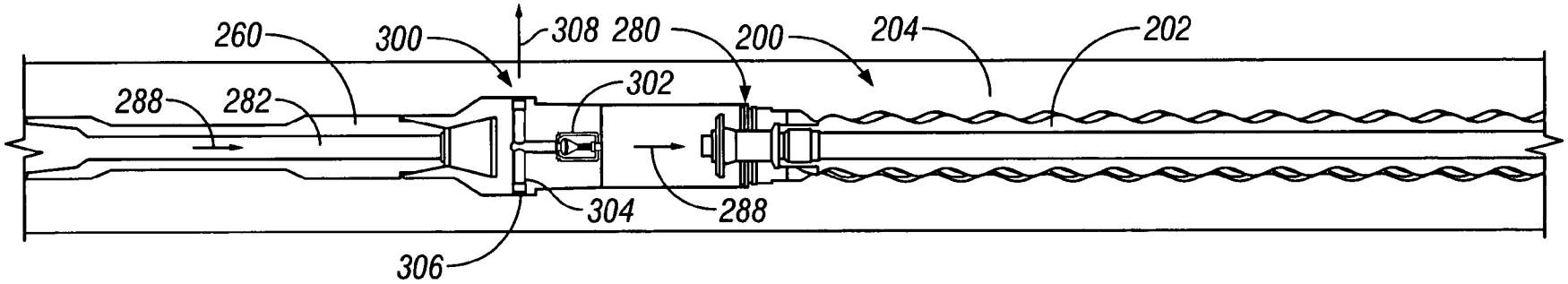
FIGS. 4A–D are schematic illustrations of one embodiment of an arrangement according to the present invention wherein a positive displacement motor is coupled to a positive displacement pump (the APD Device)
Figure 4B:
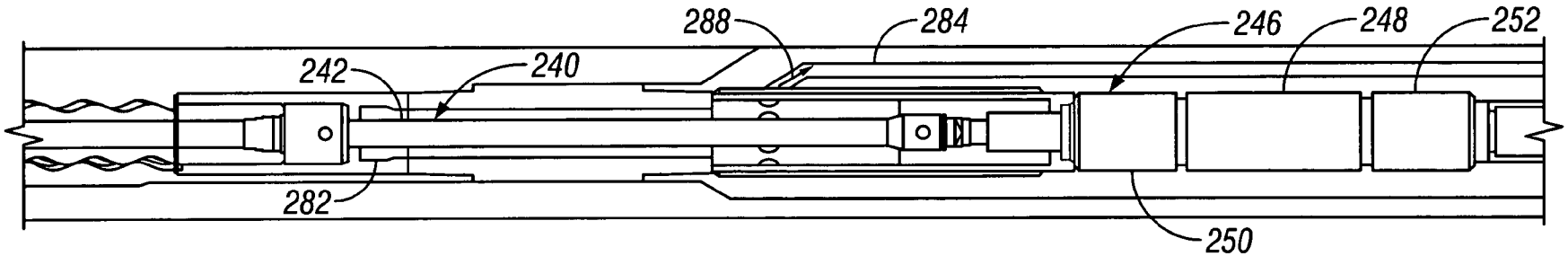
Figure 4C:
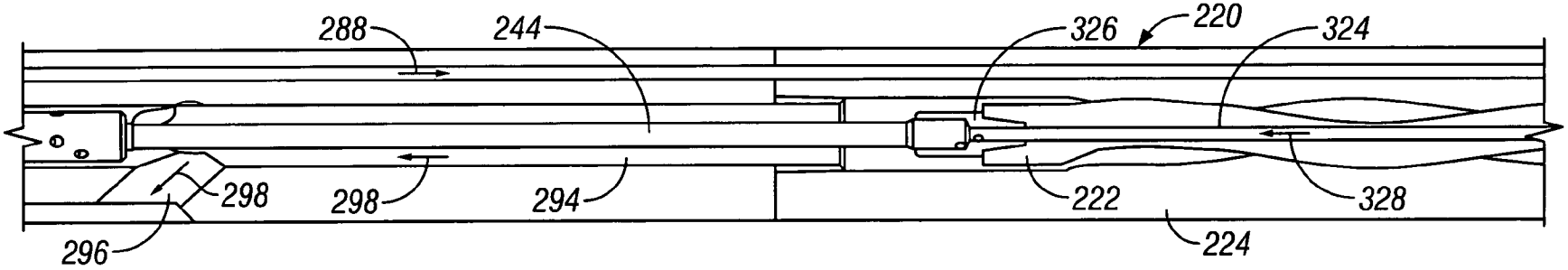
Figure 4D:
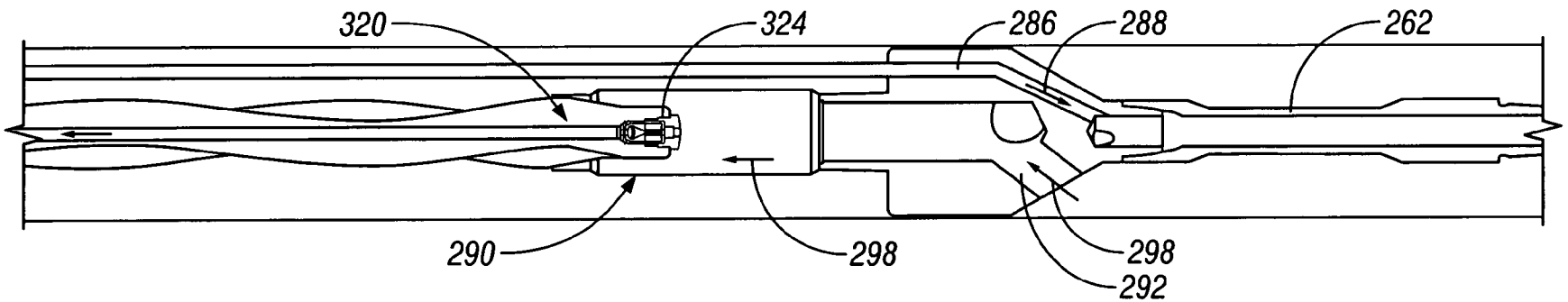

As noted earlier and shown in FIG. 2, an APD Device 170*a* may be attached to the wellbore in a manner that will allow the drill string 121 to move while the APD Device 170*a* remains at a fixed location. FIG. 3 shows an embodiment wherein the APD Device is attached to the wellbore inside and is operated by a suitable device 172*a*. Thus, the APD device can be attached to a location stationary relative to said drill string such as a casing, a liner, the wellbore annulus, a riser, or other suitable wellbore equipment. The APD Device 170*a* is preferably installed so that it is in a cased upper section 129. The device 170*a* is controlled in the manner described with respect to the device 170 (FIG. 1A).

Referring now to FIGS. 4A–D, there is schematically illustrated one arrangement wherein a positive displacement motor/drive 200 is coupled to a moineau-type pump 220 via a shaft assembly 240. The motor 200 is connected to an upper string section 260 through which drilling fluid is pumped from a surface location. The pump 220 is connected to a lower drill string section 262 on which the bottomhole assembly (not shown) is attached at an end thereof. The motor 200 includes a rotor 202 and a stator 204. Similarly, the pump 220 includes a rotor 222 and a stator 224. The design of moineau-type pumps and motors are known to one skilled in the art and will not be discussed in further detail.

The shaft assembly 240 transmits the power generated by the motor 200 to the pump 220. One preferred shaft assembly 240 includes a motor flex shaft 242 connected to the motor rotor 202, a pump flex shaft 244 connected to the pump rotor 224, and a coupling shaft 246 for joining the first and second shafts 242 and 244. In one arrangement, a high-pressure seal 248 is disposed about the coupling shaft 246. As is known, the rotors for moineau-type motors/pump are subject to eccentric motion during rotation. Accordingly, the coupling shaft 246 is preferably articulated or formed sufficiently flexible to absorb this eccentric motion. Alternately or in combination, the shafts 242, 244 can be configured to flex to accommodate eccentric motion. Radial and axial forces can be borne by bearings 250 positioned along the shaft assembly 240. In a preferred embodiment, the seal 248 is configured to bear either or both of radial and axial (thrust) forces. In certain arrangements, a speed or torque converter 252 can be used to convert speed/torque of the motor 200 to a second speed/torque for the pump 220. By speed/torque converter it is meant known devices such as variable or fixed ratio mechanical gearboxes, hydrostatic torque converters, and a hydrodynamic converters. It should be understood that any number of arrangements and devices can be used to transfer power, speed, or torque from the motor 200 to the pump 220. For example, the shaft assembly 240 can utilize a single shaft instead of multiple shafts.

As described earlier, a comminution device can be used to process entrained cutting in the return fluid before it enters the pump 200. Such a comminution device (FIG. 1A) can be coupled to the drive 200 or pump 220 and operated thereby. For instance, one such comminution device or cutting mill 270 can include a shaft 272 coupled to the pump rotor 224. The shaft 272 can include a conical head or hammer element 274 mounted thereon. During rotation, the eccentric motion of the pump rotor 224 will cause a corresponding radial motion of the shaft head 274. This radial motion can be used to resize the cuttings between the rotor and a comminution device housing 276.

The FIGS. 4A–D arrangement also includes a supply flow path 290 to carry supply fluid from the device 200 to the lower drill string section 262 and a return flow path 292 to channel return fluid from the casing interior or annulus into and out of the pump 220. The high pressure seal 248 is interposed between the flow paths 290 and 292 to prevent fluid leaks, particularly from the high pressure fluid in the supply flow path 290 into the return flow path 292. The seal 248 can be a high-pressure seal, a hydrodynamic seal or other suitable seal and formed of rubber, an elastomer, metal or composite.

Additionally, bypass devices are provided to allow fluid circulation during tripping of the downhole devices of the system 100 (FIG. 1A), to control the operating set points of the motor 200 and pump 220, and to provide safety pressure relief along either or both of the supply flow path 290 and the return flow path 292. Exemplary bypass devices include a circulation bypass 300, motor bypass 310, and a pump bypass 320.

The circulation bypass 300 selectively diverts supply fluid into the annulus 194 (FIG. 1A) or casing C interior. The circulation bypass 300 is interposed generally between the upper drill string section 260 and the motor 200. One preferred circulation bypass 300 includes a biased valve member 302 that opens when the flow-rate drops below a predetermined valve. When the valve 302 is open, the supply fluid flows along a channel 304 and exits at ports 306. More generally, the circulation bypass can be configured to actuate upon receiving an actuating signal and/or detecting a predetermined value or range of values relating to a parameter of interest (e.g., flow rate or pressure of supply fluid or operating parameter of the bottomhole assembly). The circulation bypass 300 can be used to facilitate drilling operations and to selective increase the pressure/flow rate of the return fluid.

The motor bypass 310 selectively channels conveys fluid around the motor 200. The motor bypass 310 includes a valve 312 and a passage 314 formed through the motor rotor 202. A joint 316 connecting the motor rotor 202 to the first shaft 242 includes suitable passages (not shown) that allow the supply fluid to exit the rotor passage 314 and enter the supply flow path 290. Likewise, a pump bypass 320 selectively conveys fluid around the pump 220. The pump bypass includes a valve and a passage formed through the pump rotor 222 or housing. The pump bypass 320 can also be configured to function as a particle bypass line for the APD device. For example, the pump bypass can be adapted with known elements such as screens or filters to selectively convey cuttings or particles entrained in the return fluid that are greater than a predetermined size around the APD device. Alternatively, a separate particle bypass can be used in addition to the pump bypass for such a function. Alternately, a valve (not shown) in a pump housing 225 can divert fluid to a conduit parallel to the pump 220. Such a valve can be configured to open when the flow rate drops below a predetermined value. Further, the bypass device can be a design internal leakage in the pump. That is, the operating point of the pump 220 can be controlled by providing a preset or variable amount of fluid leakage in the pump 220. Additionally, pressure valves can be positioned in the pump 220 to discharge fluid in the event an overpressure condition or other predetermined condition is detected.

Additionally, an annular seal 299 in certain embodiments can be disposed around the APD device to direct the return fluid to flow into the pump 220 (or more generally, the APD device) and to allow a pressure differential across the pump 220. The seal 299 can be a solid or pliant ring member, an expandable packer type element that expands/contracts upon receiving a command signal, or other member that substantially prevents the return fluid from flowing between the pump 220 (or more generally, the APD device) and the casing or wellbore wall. In certain applications, the clearance between the APD device and adjacent wall (either casing or wellbore) may be sufficiently small as to not require an annular seal.

During operation, the motor 200 and pump 220 are positioned in a well bore location such as in a casing C. Drilling fluid (the supply fluid) flowing through the upper drill string section 260 enters the motor 200 and causes the rotor 202 to rotate. This rotation is transferred to the pump rotor 222 by the shaft assembly 240. As is known, the respective lobe profiles, size and configuration of the motor 200 and the pump 220 can be varied to provide a selected speed or torque curve at given flow-rates. Upon exiting the motor 200, the supply fluid flows through the supply flow path 290 to the lower drill string section 262, and ultimately the bottomhole assembly (not shown). The return fluid flows up through the wellbore annulus (not shown) and casing C and enters the cutting mill 270 via a inlet 293 for the return flow path 292. The flow goes through the cutting mill 270 and enters the pump 220. In this embodiment, the controller 180 (FIG. 1A) can be programmed to control the speed of the motor 200 and thus the operation of the pump 220 (the APD Device in this instance).

It should be understood that the above-described arrangement is merely one exemplary use of positive displacement motors and pumps. For example, while the positive displacement motor and pump are shown in structurally in series in FIGS. 4A–D, a suitable arrangement can also have a positive displacement motor and pump in parallel. For example, the motor can be concentrically disposed in a pump.

Figure 5A:
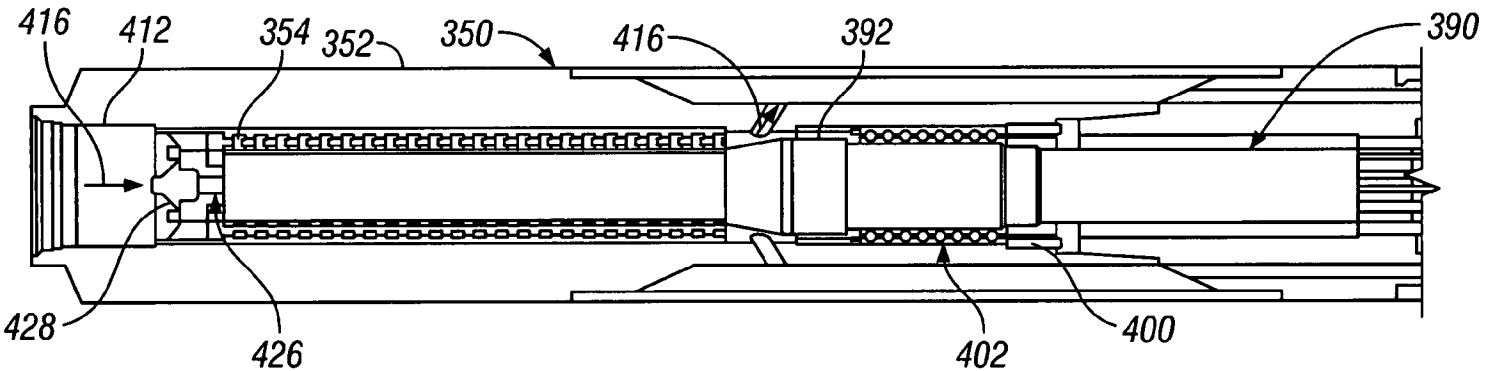
FIGS. 5A and 5B are schematic illustrations of one embodiment of an arrangement according to the present invention wherein a turbine drive is coupled to a centrifugal pump (the APD Device)
Figure 5B:
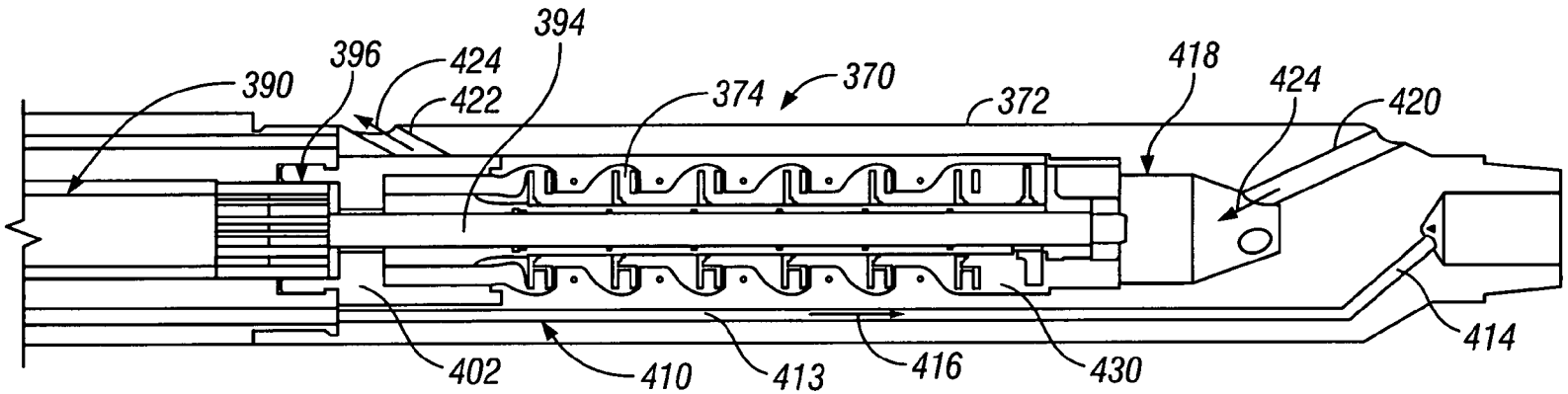

Referring now to FIGS. 5A–B, there is schematically illustrated one arrangement wherein a turbine drive 350 is coupled to a centrifugal-type pump 370 via a shaft assembly 390. The turbine 350 includes stationary and rotating blades 354 and radial bearings 402. The centrifugal-type pump 370 includes a housing 372 and multiple impeller stages 374. The design of turbines and centrifugal pumps are known to one skilled in the art and will not be discussed in further detail.

The shaft assembly 390 transmits the power generated by the turbine 350 to the centrifugal pump 370. One preferred shaft assembly 350 includes a turbine shaft 392 connected to the turbine blade assembly 354, a pump shaft 394 connected to the pump impeller stages 374, and a coupling 396 for joining the turbine and pump shafts 392 and 394.

The FIGS. 5A–B arrangement also includes a supply flow path 410 for channeling supply fluid shown by arrows designated 416 and a return flow path 418 to channel return fluid shown by arrows designated 424. The supply flow path 410 includes an inlet 412 directing supply fluid into the turbine 350 and an axial passage 413 that conveys the supply fluid exiting the turbine 350 to an outlet 414. The return flow path 418 includes an inlet 420 that directs return fluid into the centrifugal pump 370 and an outlet 422 that channels the return fluid into the casing C interior or wellbore annulus. A high pressure seal 400 is interposed between the flow paths 410 and 418 to reduce fluid leaks, particularly from the high pressure fluid in the supply flow path 410 into the return flow path 418. A small leakage rate is desired to cool and lubricate the axial and radial bearings. Additionally, a bypass 426 can be provided to divert supply fluid from the turbine 350. Moreover, radial and axial forces can be borne by bearing assemblies 402 positioned along the shaft assembly 390. Preferably a comminution device 373 is provided to reduce particle size entering the centrifugal pump 370. In a preferred embodiment, one of the impeller stages is modified with shearing blades or elements that shear entrained particles to reduce their size. In certain arrangements, a speed or torque converter 406 can be used to convert a first speed/torque of the motor 350 to a second speed/torque for the centrifugal pump 370. It should be understood that any number of arrangements and devices can be used to transfer power, speed, or torque from the turbine 350 to the pump 370. For example, the shaft assembly 390 can utilize a single shaft instead of multiple shafts.

It should be appreciated that a positive displacement pump need not be matched with only a positive displacement motor, or a centrifugal pump with only a turbine. In certain applications, operational speed or space considerations may lend itself to an arrangement wherein a positive displacement drive can effectively energize a centrifugal pump or a turbine drive energize a positive displacement pump. It should also be appreciated that the present invention is not limited to the above-described arrangements. For example, a positive displacement motor can drive an intermediate device such as an electric motor or hydraulic motor provided with an encapsulated clean hydraulic reservoir. In such an arrangement, the hydraulic motor (or produced electric power) drives the pump. These arrangements can eliminate the leak paths between the high-pressure supply fluid and the return fluid and therefore eliminates the need for high-pressure seals. Alternatively, a jet pump can be used. In an exemplary arrangement, the supply fluid is divided into two streams. The first stream is directed to the BHA. The second stream is accelerated by a nozzle and discharged with high velocity into the annulus, thereby effecting a reduction in annular pressure. Pumps incorporating one or more pistons, such as hammer pumps, may also be suitable for certain applications.

Figure 6A:
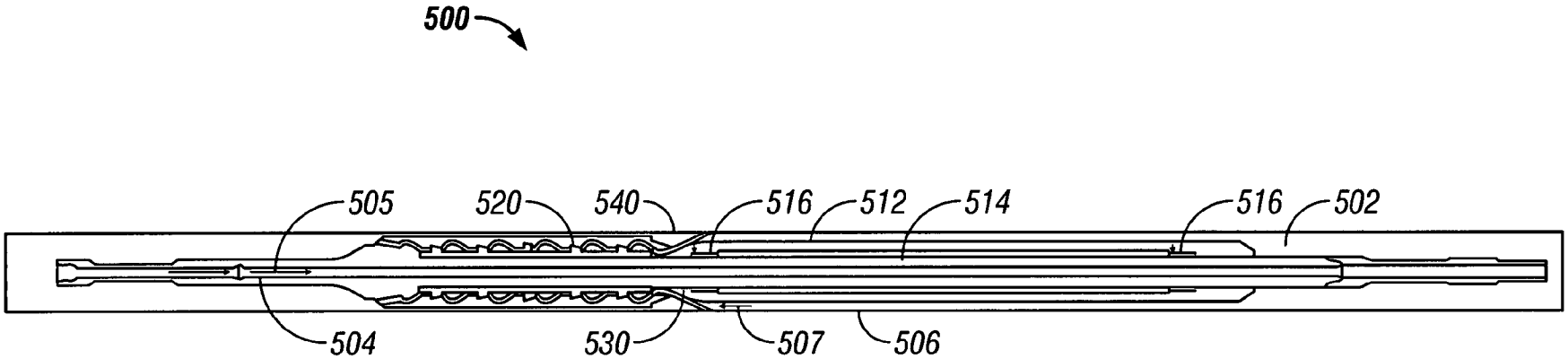
FIG. 6A is a schematic illustration of an embodiment of an arrangement according to the present invention wherein an electric motor disposed on the outside of a drill string is coupled to an APD Device.

Referring now to FIG. 6A, there is schematically illustrated one arrangement wherein an electrically driven pump assembly 500 includes a motor 510 that is at least partially positioned external to a drill string 502. In a conventional manner, the motor 510 is coupled to a pump 520 via a shaft assembly 530. A supply flow path 504 conveys supply fluid designated with arrow 505 and a return flow path 506 conveys return fluid designated with arrow 507. As can be seen, the FIG. 6A arrangement does not include leak paths through which the high-pressure supply fluid 505 can invade the return flow path 506. Thus, there is no need for high pressures seals.

In one embodiment, the motor 510 includes a rotor 512, a stator 514, and a rotating seal 516 that protects the coils 512 and stator 514 from drilling fluid and cuttings. In one embodiment, the stator 514 is fixed on the outside of the drill string 502. The coils of the rotor 512 and stator 514 are encapsulated in a material or housing that prevents damage from contact with wellbore fluids. Preferably, the motor 510 interiors are filled with a clean hydraulic fluid. In another embodiment not shown, the rotor is positioned within the flow of the return fluid, thereby eliminating the rotating seal. In such an arrangement, the stator can be protected with a tube filled with clean hydraulic fluid for pressure compensation.

Figure 6B:
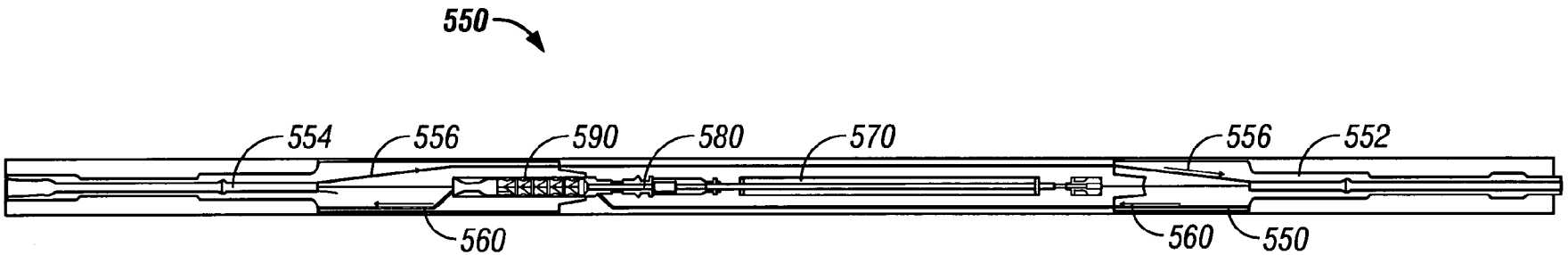
FIG. 6B is a schematic illustration of an embodiment of an arrangement according to the present invention wherein an electric motor disposed within a drill string is coupled to an APD Device.

Referring now to FIG. 6B, there is schematically illustrated one arrangement wherein an electrically driven pump 550 includes a motor 570 that is at least partially formed integral with a drill string 552. In a conventional manner, the motor 570 is coupled to a pump 590 via a shaft assembly 580. A supply flow path 554 conveys supply fluid designated with arrow 556 and a return flow path 558 conveys return fluid designated with arrow 560. As can be seen, the FIG. 6B arrangement does not include leak paths through which the high-pressure supply fluid 556 can invade the return flow path 558. Thus, there is no need for high pressures seals.

It should be appreciated that an electrical drive provides a relatively simple method for controlling the APD Device. For instance, varying the speed of the electrical motor will directly control the speed of the rotor in the APD device, and thus the pressure differential across the APD Device. Further, in either of the FIG. 6A or 6B arrangements, the pump 520 and 590 can be any suitable pump, and is preferably a multi-stage centrifugal-type pump. Moreover, positive displacement type pumps such a screw or gear type or moineau-type pumps may also be adequate for many applications. For example, the pump configuration may be single stage or multi-stage and utilize radial flow, axial flow, or mixed flow. Additionally, as described earlier, a comminution device positioned downhole of the pumps 520 and 590 can be used to reduce the size of particles entrained in the return fluid.

It will be appreciated that many variations to the above-described embodiments are possible. For example, a clutch element can be added to the shaft assembly connecting the drive to the pump to selectively couple and uncouple the drive and pump. Further, in certain applications, it may be advantages to utilize a non-mechanical connection between the drive and the pump. For instance, a magnetic clutch can be used to engage the drive and the pump. In such an arrangement, the supply fluid and drive and the return fluid and pump can remain separated. The speed/torque can be transferred by a magnetic connection that couples the drive and pump elements, which are separated by a tubular element (e.g., drill string). Additionally, while certain elements have been discussed with respect to one or more particular embodiments, it should be understood that the present invention is not limited to any such particular combinations. For example, elements such as shaft assemblies, bypasses, comminution devices and annular seals discussed in the context of positive displacement drives can be readily used with electric drive arrangements. Other embodiments within the scope of the present invention that are not shown include a centrifugal pump that is attached to the drill string. The pump can include a multi-stage impeller and can be driven by a hydraulic power unit, such as a motor. This motor may be operated by the drilling fluid or by any other suitable manner. Still another embodiment not shown includes an APD Device that is fixed to the drill string, which is operated by the drill string rotation. In this embodiment, a number of impellers are attached to the drill string. The rotation of the drill string rotates the impeller that creates a differential pressure across the device.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A drilling system for drilling a wellbore, comprising:

(a) a drill string;

(b) a source of drilling fluid supplying drilling fluid under pressure into the drill string (a "supply fluid"), the drilling fluid returning uphole via an annulus around the drill string (a "return fluid"); and (c) an active pressure differential device ("APD Device") associated with the return fluid to create a pressure drop across said APD Device to reduce pressure in the annulus around the drill string downhole of said APD Device.

2. The drilling system of claim 1, wherein said APD Device is selected from one of (a) a positive displacement pump, (b) a centrifugal type pump, and (c) a Moineau-type pump.

3. The drilling system of claim 1 further comprising: a drive assembly coupled to said APD Device and energizing said APD Device.

4. The drilling system of claim 3, wherein said drive assembly is selected from one of (a) a positive displacement drive, (b) a turbine drive, (c) an electric motor, (d) a hydraulic motor, (e) a Moineau-type motor, and (f) a rotating drill string.

5. The drilling system of claim 3 further comprising a speed converter interposed between said drive assembly and said APD device, said speed converter being adapted to convert a first speed associated with said drive assembly to a selected second speed associated with said APD device.

6. The drilling system of claim 5, wherein said speed converter is selected from a group consisting of (i) a gear drive, (ii) a hydrostatic drive, and (iii) a hydrodynamic drive.

7. The drilling system of claim 3 further comprising a bypass selectively diverting fluid around said drive assembly.

8. The drilling system of claim 1 further comprising a bypass selectively diverting fluid around said APD device.

9. The drilling system of claim 1 further comprising an annular seal disposed around said APD device, said annular seal causing the return fluid to flow into said APD device and allowing said APD device to create a differential pressure thereacross.

10. The drilling system of claim 1 further comprising a controller operatively connected to said APD Device, the controller controlling the operation of said APD Device.

11. The drilling system of claim 10, wherein said controller is located at one of: (i) at the surface; (ii) in a drilling assembly attached to the drill string; and (iii) adjacent said APD Device.

12. The drilling system of claim 10, wherein said controller controls said APO Device in response to one of: (i) a parameter of interest; (ii) programmed instructions provided to said controller; (iii) instructions from a remote location; and (iv) a downhole measured parameter.

13. The drilling system of claim 10, wherein said controller includes one of (a) a microprocessor and a memory, and (b) a hydro-mechanical device.

14. The drilling system of claim 10, wherein said controller is positioned in the wellbore; and further comprises a telemetry system for transmitting signals to said controller.

15. The drilling system of claim 10, wherein said controller controls the operation of said APD Deviee to control the pressure in the wellbore to one of: (i) maintain the wellbore boftomhole pressure at a predetermined value; (ii) maintain the wellbore bottomhole pressure within a selected range; (iii) maintain an at-balance condition; and (iv) maintain an under-balance condition.

16. The drilling system of claim 1 further comprising a blocking device downhole of said APD Device that blocks the return fluid flow when the drilling fluid supply is interrupted or stopped.

17. The drilling system of claim 1, wherein said APD device is attached to one of (a) said drill string, (b) a location stationary relative to said drill string, (c) the annulus, and (d) a riser.

18. A drilling system for drilling a wellbore, comprising:

(a) a drill string;

(b) a source of drilling fluid supplying drilling fluid under pressure into the drill string (a "supply fluid") the drilling fluid returning uphole via an annulus around the drill string (a "return fluid");

(c) an active pressure differential device ("APD Device") associated with the return fluid to create a pressure drop across said APD Device to reduce pressure in the annulus around the drill string downhole of said APD Device; and (d) a comminution device positioned downhole of said APD device, said comminution device configured to reduce the size of cuttings entrained in the return fluid.

19. The drilling system of claim 18, wherein said comminution device includes a shaft coupled to a rotor associated with said APD Device and a conical head mounted on an end thereof, said shaft having a radial motion corresponding to an eccentric motion of said rotor, said conical head thereby engaging and reducing the size of the cuttings.

20. The drilling system of claim 18, wherein said APD Device comprises a centrifugal type pump and said comminution device comprises a shearing member configured as a stage in said centrifugal type pump.

21. A drilling system for drilling a wellbore, comprising:

(a) a drill string:

(b) a source of drilling fluid supplying drilling fluid under pressure into the drill string(a "supply fluid"), the drilling fluid returning uphole via an annulus around the drill string (a "return fluid"); and (c) an active pressure differential device ("APD Device") associated with the return fluid to create a pressure drop across said APD Device to reduce pressure in the annulus around the drill string downhole of said APD Device; and (d) sensor for detecting a parameter of interest.

22. The drilling system of claim 21, wherein said sensor detects a parameter selected from a group consisting of (i) drilling parameters, (ii) drilling assembly parameters, and (iii) formation evaluation parameters.

23. The drilling system of claim 21, wherein said sensor is positioned at a predetermined location selected from a group consisting of (i) a surface location, (ii) at said APD Device, (iii) at wellhead equipment, (iv) in the supply fluid, (v) along said drill stung, (vi) at a drilling assembly connected to said drill string, (vii) in the return fluid upstream of said APD device, and (viii) in the return fluid downstream of said APD device.

24. A drilling system for drilling a wellbore, comprising (a) a drill string;

(b) a source of drilling fluid supplying drilling fluid under pressure into the drill string (a "usupply fluid"), said drilling fluid returning uphole via an annulus around the drill string (a "return fluid");

(c) an active pressure differential device ("APD Device") placed in the annulus to create a pressure drop across said APD Device to reduce pressure in the wellbore downhole of said APD Device, said APD Device in fluid communication with the return fluid; and (d) an electric drive assembly being substantially isolated from the supply fluid.

25. The drilling system of claim 24, wherein said electric drive assembly is disposed in a location selected from (a) in housing that substantially isolates said electric drive assembly from the supply fluid, and (b) on the outside of said drill string.

26. The drilling system of claim 24 further comprising a speed converter interposed between said drive assembly and said APD device, said speed converter adapted to convert a first speed associated with said drive assembly to a selected second speed associated with said APD device.

27. The drilling system of claim 26, wherein said speed converter is selected from a group consisting of (i) a gear drive, (ii) a hydrodynamic drive, and (iii) a hydrostatic drive.

28. The drilling system of claim 24 further comprising a comminution device positioned downhole of said APD device, said comminution device configured to reduce the size of particles entrained in said drilling fluid.

29. The drilling system of claim 28, wherein said comminution device is coupled to said drive assembly and energized thereby.

30. The drilling system of claim 28, wherein said comminution device comprises a shearing member configured as a stage in a centrifugal type pump associated with said APD Device.

31. The drilling system of claim 24 further comprising an annular seal disposed around said APD device, said annular seal causing drilling fluid to flow into said APD device.

32. The drilling system of claim 24, wherein said APD Device includes one of: (i) a turbine; and (ii) a centrifugal pump.

33. A method for drilling a wellbore, comprising:

(a) providing a drill string;

(b) supplying drilling fluid under pressure into the drill string (a "supply fluid"), the drilling fluid returning uphole via an annulus around the drill string (a "return fluid"); and (c) positioning an active pressure differential device ("APD Device") in fluid communication with the return fluid to create a pressure drop across the APD Device to reduce pressure in the annulus around the drill string downhole of the APD Device.

34. The method of claim 33, wherein said APD Device is selected from one of (a) a positive displacement pump, (b) a centrifugal type pump, and (c) a Moineau-type pump.

35. The method of claim 33, further comprising coupling a drive assembly to the APD Device for energizing said APD Device.

36. The method of claim 35, wherein said drive assembly is operated by one of (a) a positive displacement drive, (b) a turbine drive, (c) an electric motor, (d) a hydraulic motor, (e) a Moineau-type pump, and (f) rotation of the drill string.

37. The method of claim 35, further comprising selectively diverting fluid around the drive assembly.

38. The method of claim 33 further comprising disposing an annular seal around the APD device, the annular seal causing the return fluid to flow into the APD device and allowing the APD device to create a differential pressure.

39. The method of claim 33 further comprising controlling the operation of the APD Device with a controller that is operatively coupled to the APD Device.

40. The method of claim 39 further comprising positioning the controller at one of: (i) at the surface; (ii) in a drilling assembly attached to the drill string; and (iii) adjacent the APD Device.

41. The method of claim 39, wherein the controller controls the APO Device in response to one of: (i) a parameter of interest; (ii) programmed instructions provided to the APD Device; (iii) instructions provided to the APD Device from a remote location; and (iv) a downhole detected parameter.

42. The method of claim 39 further comprising positioning the controller in the wellbore; and transmitting signals to the controller via a telemetry system.

43. The method of claim 39, wherein the controller controls the operation of the APD Device to control the pressure in the wellbore to one of: (i) maintain the wellbore bottomhole pressure at a predetermined value; (ii) maintain the wellbore bottomhole pressure within a selected range; (iii) maintain an at-balance condition; and (iv) maintain an under-balance condition.

44. The method of claim 33 further comprising attaching the APD device to one of (a) the drill string, (b) a location stationary relative to the drill string, (c) the annulus, and (d) a riser.

45. The method of claim 33, further comprising selectively diverting fluid around the APD Device.

46. A method for drilling a wellbore, comprising:

(a) providing a drill string:

(b) supplying drilling fluid under pressure into the drill string (a "supply fluid"), the drilling fluid returning uphole via an annulus around the drill string (a "return fluid");

(c) positioning an active pressure differential device ("APD Device") in fluid communication with the return fluid to create a pressure drop across the APD Device to reduce pressure in the annulus around the drill string downhole of the APD Device; and (d) positioning a comminution device downhole of the APD device, the comminution device configured to reduce the size of cuttings entrained in the return fluid.

47. The method of claim 46, wherein the comminution device includes a shaft coupled to a rotor associated with the APD Device and a conical head mounted on an end thereof, the shaft having a radial motion corresponding to an eccentric motion of the rotor, the conical head thereby engaging and reducing the size of the cuttings.

48. The method of claim 46, wherein the APD Device comprises a centrifugal type pump and the comminution device comprises a shearing member configured as a stage in the centrifugal type pump.

49. A method for drilling a wellbore, comprising:

(a) providing a drill string;

(b) supplying drilling fluid under pressure into the drill string (a "supply fluid"), the drilling fluid returning uphole via an annulus around the drill string (a "return fluid");

(c) positioning an active pressure differential device ("APD Device") in fluid communication with the return fluid to create a pressure drop across the APD Device to reduce pressure in the annulus around the drill string downhole of the APD Device; and (d) detecting a parameter of interest with a sensor.

50. The method of claim 49, wherein the sensor detects a parameter selected from a group consisting of (i) drilling parameters, (ii) drilling assembly parameters, and (iii) formation evaluation parameters.

51. The method of claim 49 further comprising positioning the sensor at a predetermined location selected from a group consisting of (i) a surface location, (ii) at the APD Device, (iii) at wellhead equipment, (iv) in the supply fluid, (v) along the drill string, (vi) at a drilling assembly connected to the drill string, (vii) in the return fluid upstream of the APD device, and (viii) in the return fluid downstream of the APD device.

52. A method for drilling a wellbore, comprising (a) providing a drill string;

(b) supplying drilling fluid under pressure into the drill string (a "supply fluid"), the drilling fluid returning uphole via an annulus around the drill string (a "return fluid");

(c) placing an active pressure differential device ("APD Device") in the annulus to create a pressure drop across the APD Device to reduce pressure in the wellbore downhole of the APD Device, the APD Device in fluid communication with the return fluid; and (d) driving the APD device with an electric drive assembly that is substantially isolated from the supply fluid.

53. The method of claim 52 further comprising disposing the electric drive assembly in a location selected from (a) in a housing that substantially isolates the electric drive assembly from the supply fluid, and (b) on the outside of the drill string.

54. The method of claim 52 further comprising positioning a comminution device downhole of the APD device, the comminution device configured to reduce the size of particles entrained in the return fluid.

55. The method of claim 52 further comprising disposing an annular seal around the APD device, the annular seal causing drilling fluid to flow into the APD device and providing a pressure differential across the APD device.

56. The method of claim 52, wherein said APD Device includes one of: (i) a turbine; and (ii) a centrifugal pump.

57. A drilling system for drilling a wellbore, comprising (a) a drill string having a drill bit at an end thereof;

(b) a source of drilling fluid supplying drilling fluid under pressure into the drill string (a "supply fluid"), the drilling fluid returning uphole via an annulus around the drill string (a "return fluid");

(c) an active pressure differential device ("APD Device") associated with the return fluid to create a pressure drop across said APD Device to reduce pressure in the annulus around the drill string downhole of said APD Device, the APD Device operating substantially independently of rotation of the drill bit.

58. A method for drilling a wellbore, comprising (a) conveying a drill string having a drill bit into the wellbore;

(b) supplying drilling fluid under pressure into the drill string (a "supply fluid"), the drilling fluid returning uphole via an annulus around the drill string (a "return fluid");

(c) positioning en active pressure differential device ("APD Device") in fluid communication with the return fluid;

(d) operating the APD Device to create a pressure drop across the APD Device to reduce pressure in the annulus around the drill string downhole of the APD Device; and (d) rotating the drill bit substantially independently of operating the APD Device.

59. A drilling system for drilling a wellbore, comprising:

(a) a drill string;

(b) a source of drilling fluid supplying drilling fluid under pressure into the drill string (a "supply fluid"), the drilling fluid returning uphole via an annulus around the drill string (a "return fluid"); and (c) an active pressure differential device ("APD Device") associated with the return fluid to control pressure in the annulus around the drill string downhole of said APD Device to at least partially offset an equivalent circulating density associated with the flowing drilling fluid.

60. A method for drilling a wellbore, comprising:

(a) conveying a drill string into the wellbore;

(b) supplying drilling fluid under pressure into the drill string (a "supply fluid"), the drilling fluid returning uphole via an annulus around the drill string (a "return fluid");

(c) positioning an active pressure differential device ("APD Device") in fluid communication with the return fluid; and (d) operating the APD Device to at least partially offset an equivalent circulating density associated with the flowing drilling fluid.

* * * * *